United States Patent [19]

Wave et al.

[11] Patent Number: 4,546,346

[45] Date of Patent: Oct. 8, 1985

[54] SEWER LINE BACKUP DETECTION, ALARM AND DETENTION APPARATUS

[75] Inventors: Larry E. Wave; Richard S. Woods, both of West Palm Beach, Fla.

[73] Assignee: Sanity Saver Cap Company, Wilmington, Del.

[21] Appl. No.: 475,688

[22] Filed: Mar. 14, 1983

[51] Int. Cl.[4] ..... G08B 21/00

[52] U.S. Cl. ..... 340/608; 200/61.2; 200/83 R; 340/611; 340/616

[58] Field of Search ..... 340/608, 620, 611, 616, 340/626; 200/83 R, 61.2, 61.21, 81.4, 81.5, 83 W, 83 WM, 83 Y, 83 F

[56] References Cited

U.S. PATENT DOCUMENTS

| | | | |
|---|---|---|---|
| 1,164,882 | 12/1915 | Sommer | 340/620 |
| 2,761,037 | 8/1956 | Thomas et al. | 340/608 X |
| 3,757,316 | 9/1973 | Fiorenzo | 340/608 |

FOREIGN PATENT DOCUMENTS

| | | | |
|---|---|---|---|
| 923812 | 4/1963 | United Kingdom | 340/632 |

*Primary Examiner*—Charles A. Ruehl
*Assistant Examiner*—Daniel Myer
*Attorney, Agent, or Firm*—Mortenson & Uebler

[57] ABSTRACT

A sewer line backup detection device and alarm are provided which can be installed in place of the cleanout access cap in a conventional sewer line. The device comprises a housing having male connecting threads adapted to fit standard female receptacles which have been used in the past to provide cleanout access to sewer lines, the housing containing alarm means or alarm transmitting means actuated by a pneumatic switch. The pneumatic switch is actuated by a flexible diaphragm which is fitted snugly onto the lower end of the housing which extends into the sewer line. In the event of a blockage of the sewer line, the blocked material exerts pressure on the flexible diaphragm which closes the pneumatic switch thereby setting off an alarm, either locally or at a remote location such as the dwelling from which the sewer line exhausts. The alarm system is utilized especially advantageously in combination with a detention tank located in the basement or lower level of a high rise building. In such a situation, a blockage is detected virtually immediately upon occurrence providing time to issue warnings to upper level users not to use the sewer system, thereby preventing an overflow at the first floor level and avoiding the damage and aggravation caused by such an overflow.

10 Claims, 8 Drawing Figures

SEWER LINE BACKUP DETECTION, ALARM AND DETENTION APPARATUS

BACKGROUND OF THE INVENTION

The present invention relates to a device for the detection of blockages in sewer lines and which sounds an alarm upon the detection of such blockage, and, coupled with a detention tank, provides time to alert users of the system of the blockage and stop further use of the system until the blockage is removed, thereby preventing overflow of the sewers into the building being served. Backup of sanitary sewer systems can cause deposit of sewage-laden liquids and solids in the lower levels of residential homes and the like, resulting in untold aggravation, grief, physical damage to the premises and wholly unsanitary conditions. This invention provides inexpensive means for detecting a sewer blockage, sounding an alarm and preventing an overflow.

Sewer blockage alarms are known in the prior art. Exemplary of such devices are shown in prior U.S. Pat. No. 3,202,165 (Yavicoli, 1965); U.S. Pat. No. 2,985,187 (Hamilton, 1961); U.S. Pat. No. 2,630,875 (Sachs, 1953), and U.S. Pat. No. 354,688 (Clark, 1886). The distinct differences and advantages of the present invention over prior art devices will become apparent during the course of the following description.

SUMMARY OF THE INVENTION

A device is provided for detecting a blockage in a sewer line of a sewer system and issuing an alarm to users of the sewer system, the device comprising a housing, generally circular in horizontal cross-section and having male connecting threads adapted to fit the female threads of conventional access ports to sewer lines, the housing containing means for issuing an alarm, which means are actuated by a pneumatic switch located in said housing, the pneumatic switch being actuated by a flexible diaphragm fitted snugly onto the lower end of the housing, the diaphragm effectively sealing the interior of the housing from the environment, the lower end of the housing extending into the access port such that the flexible diaphragm is located substantially at the inside diameter of the sewer line, whereby, in the event of the blockage of the sewer line, the blocked material exerts pressure on the flexible diaphragm which deforms under pressure and actuates the pneumatic switch and an alarm is issued.

Preferably the means for issuing an alarm includes a power supply self-contained within the housing of the alarm device. The alarm, either visual, audio or other type, may be self-contained within the housing, or located remote from the device, say within a dwelling, or both.

In addition, the alarm device is provided in combination with a detention tank connected in parallel vertical relationship with a basement level sewer line, thereby providing means to accumulate sewage backup material, and giving upper floor level users of the sewer system additional time after an alarm is sounded to stop further use of the system and thereby prevent first floor infiltration.

Figure 1:
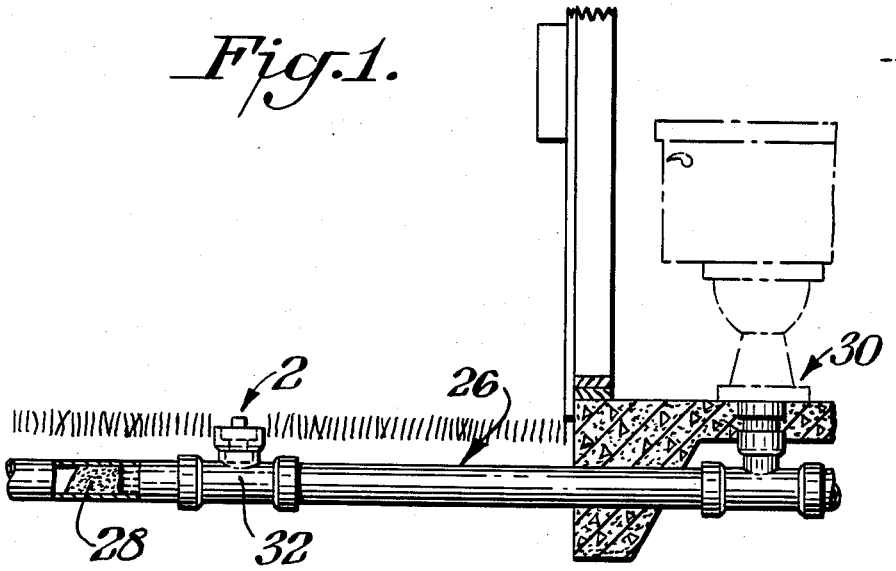
FIG. 1 is a side elevational view in part broken away and in part schematic, of the sewer alarm device of this invention installed in a conventional sewer cap fitting in a sewer line extending from a residence to a sewer (not shown).

DETAILED DESCRIPTION OF THE INVENTION AND PREFERRED EMBODIMENTS WITH REFERENCE TO THE DRAWINGS

A sewer line backup detection device and alarm are provided which can be installed in place of the cleanout access cap in a conventional sewer line. The device comprises a housing having male connecting threads adapted to fit standard female receptacles which have been used in the past to provide cleanout access to sewer lines, the housing containing alarm means or alarm transmitting means actuated by a pneumatic switch. The pneumatic switch is actuated by a flexible diaphragm which is fitted snugly onto the lower end of the housing which extends into the sewer line. In the event of a blockage of the sewer line, the blocked material exerts pressure on the flexible diaphragm which closes the pneumatic switch thereby setting off an alarm, either locally or at a remote location such as the dwelling from which the sewer line exhausts.

This invention affords its owner a more viable and effective method of early detection through the utilization of either a self-contained buzzer or similar device or by conveying this warning signal in a convenient, dependable and wireless fashion to a more desirable location by means of a self-contained transmitting device, or the combination of both. This is not to exclude the possibility of using wires to connect this device directly to a warning device elsewhere should the particular circumstances warrant.

It should be pointed out that the design of this device, particularly the total enclosure of all its working parts and the resulting isolation of those parts from both the outside environment and the potentially corrosive nature of a sewer system, will assure a dependable and durable operation.

The alarm system is utilized especially advantageously in combination with a detention tank located in the basement or lower level of a high rise building. This tank would prevent certain sewer backup conditions and particularly those conditions that commonly occur on the first floor of a multi-story building when there is a sewer blockage between the basement of said building and the sewer system. This sort of blockage creates a particular problem because continuous sewer back flow will invade the first floor until the occupants in the above floors discontinue use of their drainage systems. Although the existence of basement floor drains in line with these sewer pipes may prevent such first floor infiltration, such drains present a health hazard and, at best, a very uncomfortable solution.

The detention tank can be easily installed parallel to the vertical sewer stack in a basement. This reservoir is designed to hold enough sewage as to prevent it from backing up to the first floor level, thus affording time for the correction of the problem or at least allowing time to notify the drain users above. In such a situation, a blockage is detected virtually immediately upon occurrence providing time to issue warnings to upper level users not to use the sewer system, thereby preventing an overflow at the first floor level and avoiding the damage and aggravation caused by such an overflow.

Installation of this detention tank is a relatively simple matter, whether dealing with new construction or old. After installation, the compact design of this apparatus assures minimal interference with surroundings. An added possible usage of this device would be to temporarily hold sewage pumped backwards from a near-by lift station should it become necessary to reverse the lift station pumps due to binding. A possible added feature of this device might be the inclusion of a shut-off valve installed directly above the alarm device of this invention. This valve could be manually shut off before opening the access port holding the alarm device should it be desirable or necessary to invade the sewer stack with a sewer cleaning machine at this point. After stoppage is cleared and the cap is replaced, the shut-off valve would then be disengaged allowing stored sewage to travel back down the sewer line and be disposed of.

A detailed description of the invention is best provided with reference to the drawings wherein FIG. 1 shows the alarm device 2 of this invention installed in "T" joint 32 in sewer line 26 through which sewage from house plumbing 30 is exhausted. A blockage 28 is depicted in the broken-away portion of sewer line 26.

Figure 2:
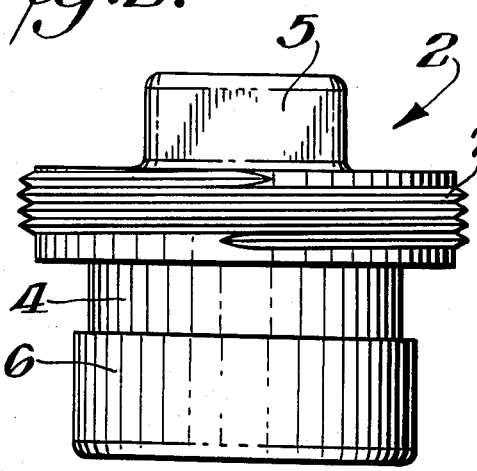
FIG. 2 is a side elevational view of the alarm device of this invention.

FIG. 2 shows the external construction of alarm device 2 in side elevation wherein alarm housing 4 has threads 7 and substantially square upward projection 5 to enable the device to be fitted into conventional sewer line cap receptacles using standard wrenches. The flexible diaphragm 6 fitted over the bottom end of housing 4 is described in more detail in connection with the description of FIG. 4.

Figure 3:
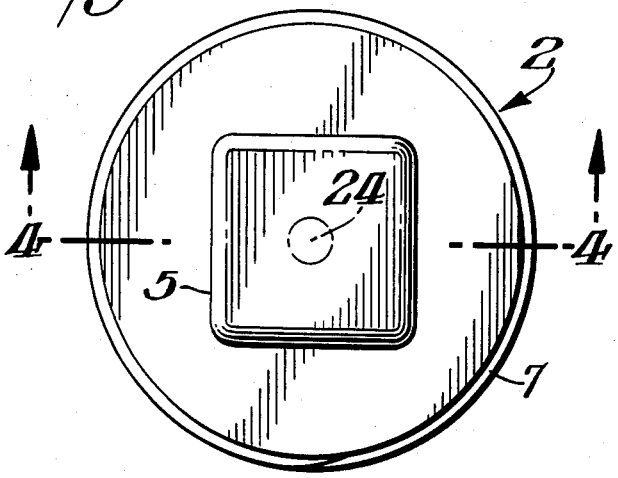
FIG. 3 is a top plan view of the alarm device.

FIG. 3 is a top plan view of the alarm device 2 showing wrench projection 5 and optional alarm light 24 which may be a light emitting diode.

Figure 4:
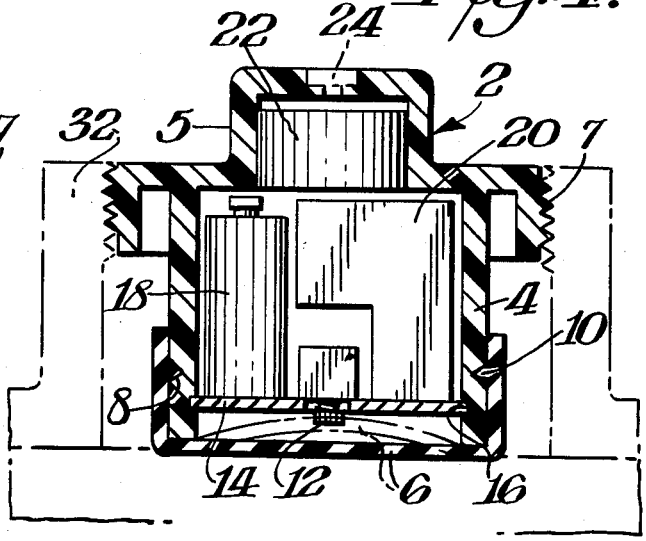
FIG. 4 is a cross-sectional view taken substantially along line 4—4 of FIG. 3.

FIG. 4, a cross-sectional view of alarm device 2 taken along line 4—4 of FIG. 3 shows housing 4 having upper wrench projection 5 and threads 7 which fit into standard sewer receptacle connection 32. Over the bottom of housing 4, fitted snugly, is flexible diaphragm 6 which, when installed in a sewer line, is in proximity to the inside wall of the sewer line so as not to obstruct flow but to be in contact with and pressured by any back up of material which may occur. Located inside the housing are pneumatic switch 12, self-contained power source (battery) 18, optional transmitting device 20, alarm buzzer 22 and optional alarm light 24. It will be readily apparent that an external power source and external alarm means can also be employed. Base plate 14, preferably metal, is simply snapped into groove 16 for supporting the internal components of the device, providing ease of replacement parts such as batteries. The "V" projection 10 of the flexible diaphragm extends into the "V" groove 8 in housing 4 to provide a snug fit for the diaphragm and sealing the internal components from the environment. Housing 4 is preferably a durable plastic material. Diaphragm 6 is liquid and gas proof and structurally durable enough to withstand considerable pressure as exists in a backup condition. The diaphragm may be constructed from a flexible plastic or sythetic rubber or other similar material. When a backup occurs, diaphragm 6 deforms under pressure as shown in phantom in FIG. 4 closing the pneumatic switch 12 which causes audio or visual alarms or both to issue from audio alarm 22 and light 24.

Figure 5:
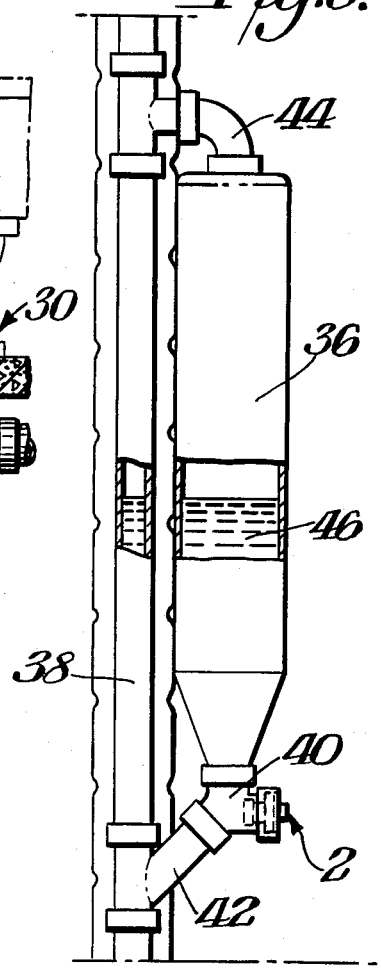
FIG. 5 is a side elevation, in part broken away, of the combination alarm device and detention tank according to this invention.

FIG. 5 shows the alarm device 2 of this invention installed in a line near the bottom of the detention tank 36 installed in a sewer system in parallel connection with the sewer line 38. Conventional "Y" connection 42, three-way connection 40 and right angle connection 44 may be used. Upon backup of the sewer system, sewage material 46 flows back into the tank 36 rather than rising into the dwelling or commercial establishment in which the system is installed. In use, alarm device 2 has issued an alarm long prior to liquid rising to the level shown in FIG. 5. The illustration is provided to indicate that the added time provided by the system to alert users can be extended greatly, and is proportional to the size of the detention tank employed. A 110 to 120 gallon tank should prove satisfactory.

The main portion of this apparatus 36 involves a hollow tank constructed of either PVC or cast iron which extends vertically and parallel to a basement or other sublevel sewer stack 38. It is sharply tapered toward the bottom where it is connected to a tubular junction 40 that has three outlets. This junction coupling in turn is directly connected to the vertical stack 38 by means of a "Y" junction 42. The remaining outlet of junction 40 is designed to accept the alarm device 2 which threads into the outlet.

Referring to FIG. 5, as the back flow of sewage rises through sewer pipe 38 and reaches "Y" coupling 42, a portion of the back flow will be diverted into the bottom section of tank 36 where it will exert pressure on the inner side of alarm device 2. Sewage will continue to rise for a time after alarm 2 is activated, with tank 36 having a considerable capacity to allow ample time for sewer service personnel to arrive or at least to terminate the use of the subject sewer line before sewage overflows onto the first floor above.

After the sewage stoppage has been removed, the sewage will immediately run out of sewer stack 38 and, at the same time, aided by the smooth and sharply tapered design of the entire apparatus interior, the sewage will empty from it as well, thus rendering this device virtually maintenance-free.

Figure 6:
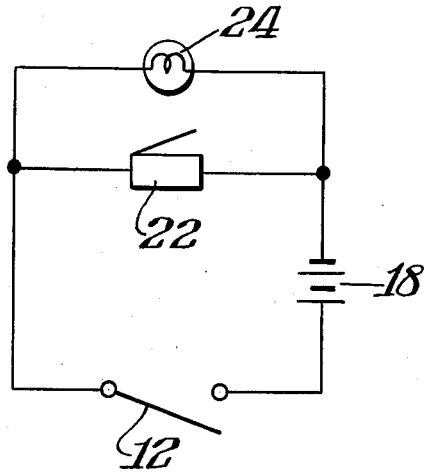
FIG. 6 is a schematic diagram of an electrical circuit connecting the components of the invention including switch, power supply, audible alarm and visual alarm.

FIG. 6 shows a schematic electrical diagram of a self-contained device wherein pneumatic switch 12 closes to sound alarm 22 and light the diode 24, power being supplied by battery 18.

Figure 7A:
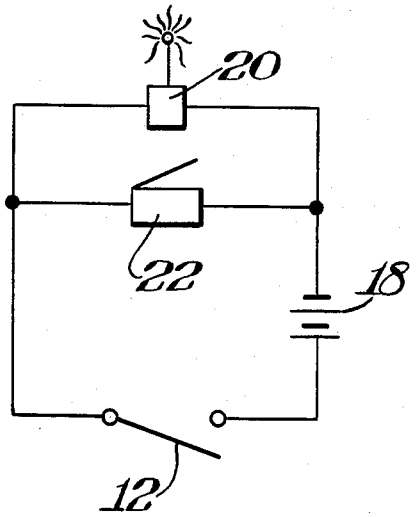
FIG. 7A is a schematic diagram of an electrical circuit to be used for transmitting a signal upon sewer blockage to a remote alarm as well as sounding a local alarm, including switch, power supply, local audible alarm and transmitter.
Figure 7B:
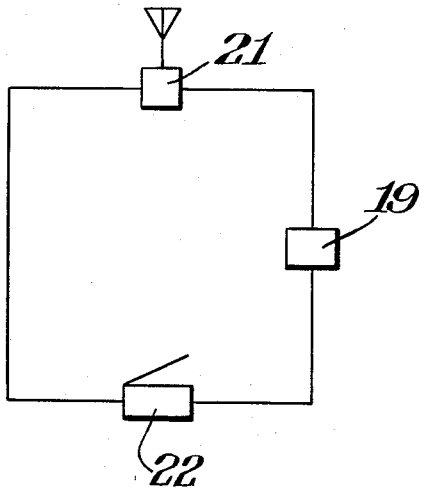
FIG. 7B is a schematic diagram of an electrical circuit to be used for receiving a remote signal from the alarm device of this invention and sounding an alarm including receiver, audio alarm and d.c. adapter.

FIG. 7A schematically represents circuitry wherein the alarm device transmits a signal to a remote location via transmitting device 20 when switch 12 is closed, power supplied by battery 18, the signal being received by receiver 21 which sounds alarm 22, as shown in FIG. 7B. The device of FIG. 7A may also contain a local, internal audio alarm 22. The d.c. adapter 19 to be plugged into wall outlet is shown for completeness.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

We claim:

1. A device for detecting a blockage in a sewer line of a sewer system and issuing an alarm to users of the sewer system, said device being self-contained and comprising:

a housing, generally circular in horizontal cross-section and having male connecting threads adapted to fit the female threads of conventional access ports to sewer lines, said housing containing a power supply and means for issuing an alarm signal to alarm means, which means for issuing an alarm signal are actuated by a pneumatic switch located in said housing, and means for activating said pneumatic switch being a highly flexible diaphragm fitted snugly onto the lower end of said housing, said diaphragm effectively sealing the interior of said housing from the environment, the lower end of said housing extending into the access port such that said flexible diaphragm is located substantially at the inside diameter of said sewer line, whereby, in the event of the blockage of said sewer line, the blocked material exerts external pressure on the flexible diaphragm which deforms under pressure raising the air pressure inside said housing and actuating the pneumatic switch, said alarm signal is issued to said alarm means, and an alarm is issued.

2. The device of claim 1 wherein said alarm is contained within said housing.

3. The device of claim 2 wherein said alarm comprises sound generating alarm means.

4. The device of claim 2 comprising visual alarm means.

5. The device of claim 1 wherein said alarm is located remote from said housing.

6. The device of claim 5 wherein said alarm comprises sound generating alarm means.

7. The device of claim 5 comprising visual alarm means.

8. The device of claim 1 in combination with a detention tank connected in parallel vertical relationship with a vertical sewer line by means of upper and lower connections between said tank and sewer line, and located in the basement of a dwelling or the lower level of a multi-story building, providing means to accumulate sewage backup material, thereby giving users of said sewer system additional time after an alarm is sounded to stop further use of said system.

9. The combination of claim 8 wherein said detecting device is installed in said lower connection between said tank and sewer line.

10. The device of claim 1 wherein said means for issuing an alarm signal comprises radio transmitting means and said alarm means are located remote from said housing.

* * * * *